United States Patent [19]

Bakka et al.

[11] Patent Number: 4,653,966

[45] Date of Patent: Mar. 31, 1987

[54] DROP-DECK INTERMODAL BOGIE

[75] Inventors: Charles M. Bakka, Sparta, N.J.; Samuel H. Levinson, Glencoe, Ill.

[73] Assignee: Trailer Rail Partners, Chicago, Ill.

[21] Appl. No.: 817,261

[22] Filed: Jan. 8, 1986

[51] Int. Cl.[4] ..... B60P 1/00; B60P 3/06

[52] U.S. Cl. ..... 410/1; 410/3; 410/53; 410/57; 410/58; 105/4.1

[58] Field of Search ..... 410/1, 3, 6, 52, 53, 410/54, 56, 57, 58, 59, 60, 61, 62, 64–67; 105/3, 4 R

[56] References Cited

U.S. PATENT DOCUMENTS

| | | | |
|---|---|---|---|
| 1,923,785 | 8/1933 | Holan | 410/66 |
| 1,968,196 | 7/1934 | Francis | 410/57 |
| 2,246,543 | 6/1941 | Smith . | |
| 2,285,207 | 6/1942 | Johnson . | |
| 2,373,148 | 4/1945 | Smith . | |
| 2,709,969 | 6/1955 | Andert . | |
| 2,782,733 | 2/1957 | Ewing . | |
| 2,835,209 | 5/1958 | Kavanaugh . | |
| 2,933,053 | 4/1960 | Mellam . | |
| 2,963,986 | 12/1960 | Dobson | 410/53 |
| 2,992,621 | 7/1961 | Schoen . | |
| 3,204,579 | 9/1965 | Burns et al. . | |
| 3,348,502 | 10/1967 | Burns et al. . | |
| 3,352,438 | 11/1967 | Davidson . | |
| 3,490,389 | 1/1970 | Brown . | |
| 3,516,368 | 6/1970 | Wright . | |
| 3,576,167 | 4/1971 | Macomber . | |
| 3,584,584 | 6/1971 | Milenkovic . | |
| 3,610,168 | 10/1971 | Macomber | 410/1 |
| 3,635,362 | 1/1972 | Pratt . | |
| 3,884,158 | 5/1975 | Rumell . | |
| 4,129,079 | 12/1978 | Shannon et al. . | |
| 4,179,997 | 12/1979 | Kirwan . | |
| 4,274,776 | 6/1981 | Paton et al. | 410/3 |
| 4,385,857 | 8/1983 | Willets . | |
| 4,416,571 | 11/1983 | Krause . | |
| 4,425,064 | 1/1984 | Walda et al. . | |
| 4,516,506 | 5/1985 | Paton . | |

FOREIGN PATENT DOCUMENTS

| | | | |
|---|---|---|---|
| 23372 | 2/1981 | European Pat. Off. | 410/1 |

*Primary Examiner*—Robert B. Reeves
*Assistant Examiner*—Dennis C. Rodgers
*Attorney, Agent, or Firm*—Dressler, Goldsmith Shore, Sutker & Milnamow

[57] ABSTRACT

A system for moving receptacles such as highway semi-trailers on railway trains. The system includes a plurality of rail bogies as the sole support of adjacent rear and front ends of the trailers and as the sole connection means between the trailers, to form the trains. The rail bogie has a frame structure supported on spaced apart wheeled axles, defining a pair of end deck surfaces positioned above the wheeled axles and a central drop-deck surface disposed between and below the end deck surfaces. A vertically adjustable fifth wheel assembly is supported above each of the end deck surfaces for receipt of a semi-trailer king pin. A deck plate member is pivotally secured to the drop-deck surface. A pair of transversely spaced, longitudinally extending, internal and external rub-rail members extend upwardly from the drop-deck plate member for receipt of semi-trailer tandems therebetween. The tandems of the trailer are received and supported on the drop-deck plate between the rub-rail members of a first bogie and the king pin of the trailer is received and supported on the fifth wheel assembly of an immediately adjacent bogie.

8 Claims, 10 Drawing Figures

DROP-DECK INTERMODAL BOGIE

BACKGROUND OF THE INVENTION

1. Field of the Invention

The present invention is generally directed to railway rolling stock and more particularly to a system for transporting highway semi-trailers, and the like, by rail.

2. The Prior Art

Systems have heretofore been proposed for moving highway semi-trailers, demountable containers and other types of land moving vehicles by rail on conventional flat cars of sufficient length to support the full length of one or two of such vehicles or containers. Such flat cars have been provided with suitable means to support the highway wheels and suitable fifth wheel assemblies for receipt of the king pin. These systems have numerous disadvantages in that the great overall-height of the flat car and the semi-trailers create clearance problems and provide a vehicle with a very high center of gravity. Also such systems require time consuming and awkward circus-type loading and unloading procedures.

Attempts have been made to lower the overall height of such systems by providing highway wheel pockets in the flat car decks or providing drop-deck flat cars arranged to receive the highway wheels in the center depressed portion. In connection with the latter arrangement, turntables and transfer tables have been provided in the center depressed portions of such flat cars to receive the highway wheels and to permit side loading. Examples of such prior art systems are disclosed in U.S. Pat. Nos. 2,246,543, 2,285,207, 2,782,733, 3,352,438, 3,490,389, 4,129,079, 4,425,064, and 4,516,506.

A system for transporting highway semi-trailers by rail on rail trucks or bogies as the sole support of adjacent rear and front ends of the semi-trailers is disclosed in U.S. Pat. No. 4,179,997, assigned to Intermodal Concepts, Inc. The bogie includes a flat frame structure supported above-spaced wheeled axles. A central guideway extends from end to end of the frame structure. A pedestal structure is mounted in the guideway for movement lengthwise thereof substantially from end to end of the frame structure and for supporting a fifth wheel. A pair of highway wheel supporting structures are supported in end to end relation with each other lengthwise on the frame structure. The wheel supporting structures comprise a pair of transversely spaced longitudinally extending treadways, which are transversely spaced apart a sufficient distance so as to receive the pedestal structure between them and permit movement of the fifth wheel to selective positions alternately abreast of the highway wheel supporting structures. The wheel supporting structures accommodate the selective support of the rear highway wheels of a semi-trailer on either of the highway wheel supporting structures and the support of the front king pin of a second highway semi-trailer by the fifth wheel on the end portion of the truck frame carrying the other highway wheel supporting structure.

The system as disclosed in U.S. Pat. No. 4,179,997 has improved upon the prior systems in that it allows for the straddling of a semi-trailer between two bogies or short flat cars, thus permitting the trailer frame rails to distribute longitudinal stress. Also this system provides the ability of transporting both present length trailers and those trailers projected to be of longer length. However, this system has the disadvantage of a great overall height of the flat car and the semi-trailers which creates clearance and increased wind resistance problems. Further, this system has the disadvantage of an awkward, if not dangerous, loading and unloading procedure.

SUMMARY OF THE INVENTION

The present invention is directed to provide a system for transporting highway semi-trailers, or the like, in trains by rail, utilizing improved bogies as the sole support of adjacent rear and front ends of the trailers and as the sole connecting means between such trailers, to form trains. In so doing, the system of the present invention permits hauling of trailers of varying lengths and reduces the clearance and wind resistance of the train and also permits utilization of a safe loading and unloading procedure.

In accordance with the present invention, the system includes a rail bogie having a frame structure supported on wheeled axles positioned adjacent the respective ends thereof. The frame structure defines a pair of end deck surfaces positioned above the wheeled axles adjacent the respective ends thereof and a central drop-deck surface disposed between and below the end deck surfaces. A fifth wheel assembly is supported above each of the end deck surfaces for receipt of a king pin of a semi-trailer, which is vertically adjustable relative thereto and is preferably longitudinally movable with respect thereto. A deck plate member is pivotally secured to the drop-deck surface for rotation with respect thereto about a substantially vertical axis. A pair of transversely spaced, longitudinally extending, internal and external rub-rail members extend upwardly from the drop deck plate member for receipt of semi-trailer tandems therebetween. The drop deck plate is movable between a first position wherein the rub rail members are substantially parallel to the longitudinal axis of the frame structure and a second position wherein the rub rail members are substantially perpendicular to the longitudinal axis of the frame structure.

In accordance with the system of the present invention, a semi-trailer extends between a pair of adjacent bogies. The tandems of the trailer are received and supported on the drop-deck plate between the corresponding rub-rail members of a first bogie and the king pin of the trailer is received and supported on the fifth wheel assembly of the immediately adjacent bogie. In so doing the overall height of the bogie and semi-trailer is reduced and thus clearance is increased and wind resistance is reduced. Also, the procedure for loading and unloading the semi-trailers onto and from the bogies in accordance with the invention is facilitated by the rotating drop-deck plate and a pusher arm assembly which may be provided at the ends of the bogies.

DETAILED DESCRIPTION OF THE INVENTION

The system of the present invention for handling highway semi-trailers and moving them in trains by rail includes a plurality of rail bogies 10 constructed in accordance with the present invention.

Figure 1:
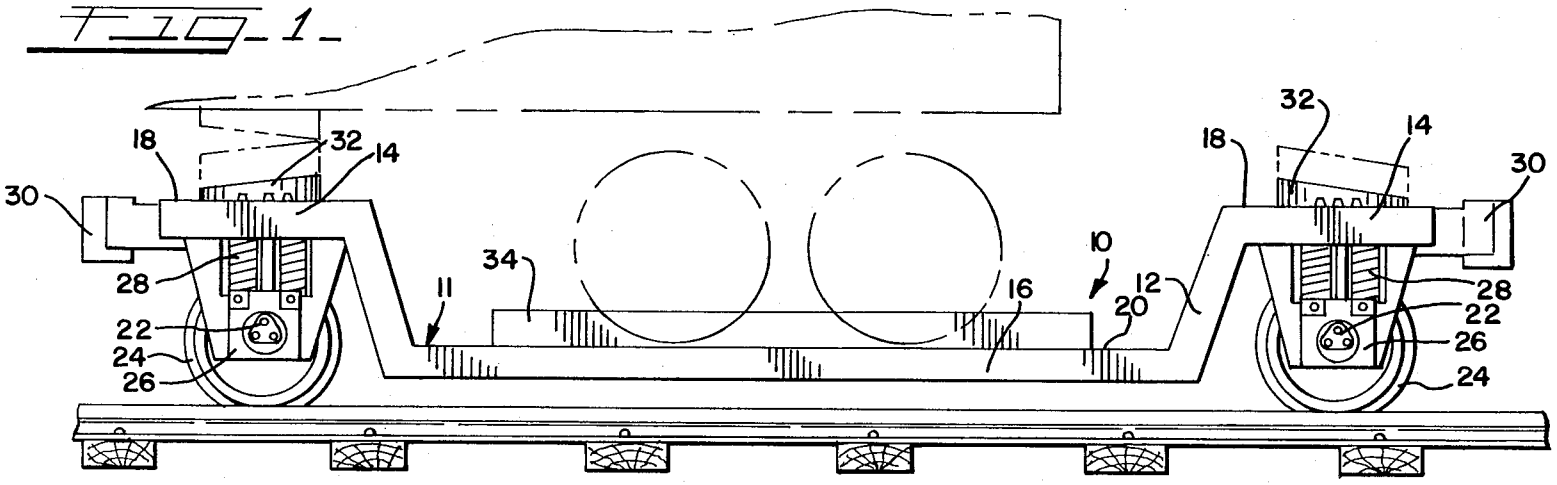
FIG. 1 is a side elevational view of a rail bogie constructed in accordance with the present invention, with a rear portion of a semi-trailer schematically represented thereon in broken lines.
Figure 2:
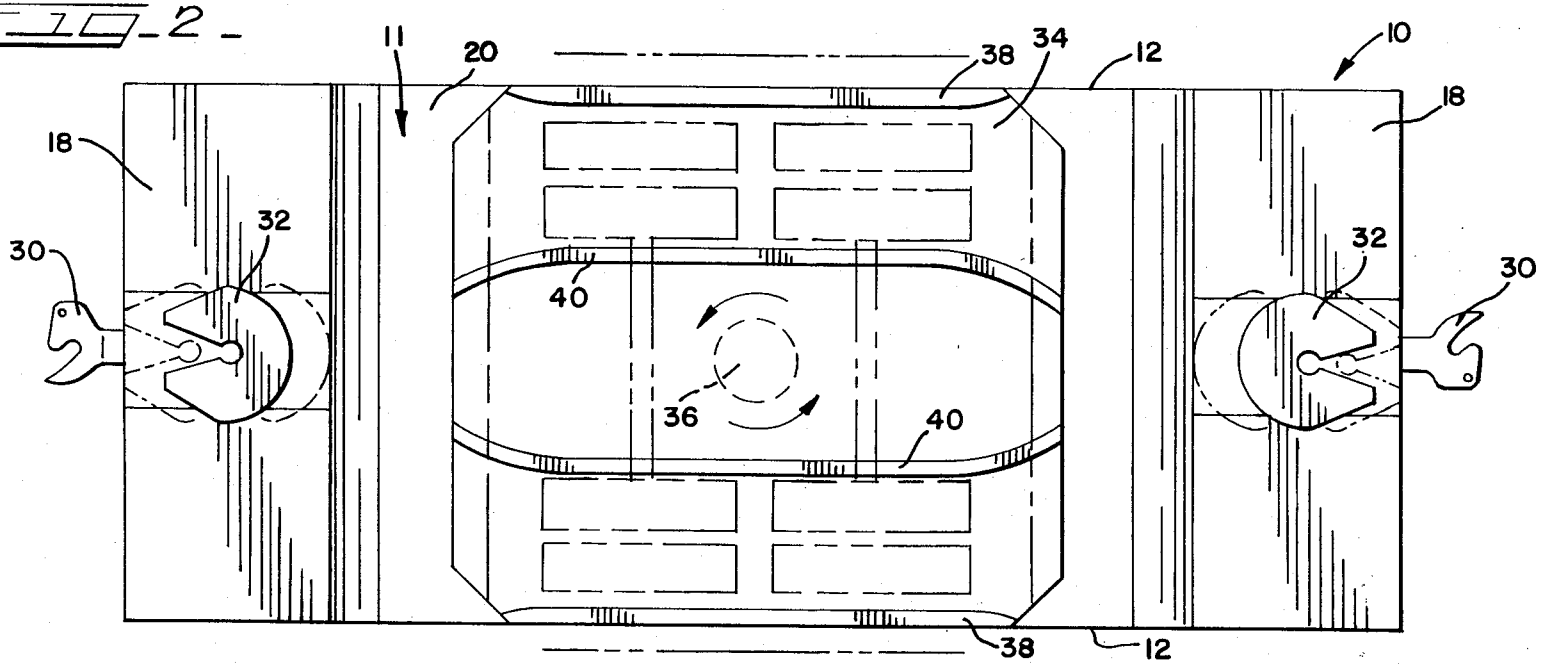
FIG. 2 is a top plan view of the rail bogie as shown in FIG. 1, with the tandems of a semi-trailer schematically represented thereon in broken lines.

Referring to FIGS. 1 and 2, rail bogie 10 includes a frame structure 11 comprising a pair of spaced apart external side frame rails 12, formed in an angle drop-deck or well-car manner, so as to define raised end portions 14 and a lowered center portion 16. Extending across the end portions 14 are substantially horizontal end deck surfaces 18 and extending across the center portion 16 is a substantially horizontal drop-deck surface 20. Frame structure 11 is preferably in the range of about twenty to twenty five feet in length, with the drop-deck surface preferably in the range of about twelve to fifteen feet.

Frame structure 11 is supported in a suitable manner above a pair of spaced apart wheeled axles 22 positioned below end deck surfaces 18. Wheeled axles 22 preferably include railway wheels 24 of a standard twenty eight inch diameter, with the axles rotating within conventional roller bearing journal boxes 26 and suspended by conventional rail springs 28. Although not shown, suitable brake rigging, valves and reservoirs are provided to conform to A.A.R./F.R.A. standards. Standard A.A.R. type couplers 30 are provided at each end of frame structure 11.

A collapsible fifth wheel assembly 32 is suitably secured to each end deck surface 18 and extends upwardly therefrom. The specific construction of fifth wheel assembly 32 does not form an integral part of the present invention. However, in order to facilitate the loading and unloading procedure of the system of the present invention, assembly 32 is preferably of a type well known in the art which can be selectively raised and lowered by manual or air/hydraulic operation. Further, although not shown in FIGS. 1–2, assembly 32 is preferably mounted to surface 18 in a manner which permits selected limited longitudinal sliding movement thereof on surface 18 in a suitable manner, as is well known in the art, on a sliding platform which permits fore and aft movement thereof of approximately eighteen inches in each direction from the midpoint of surface 18.

A deck plate member 34 is pivotably secured to drop-deck surface 20 for rotation with respect thereto about a substantially vertical axis through a pivot indicated at 36 in FIG. 2. Extending upwardly from deck plate member 34 are external rub-rail members 38 and internal rub-rail members 40. External rub-rail members 38 are preferably spaced to receive and guide a standard one hundred and two inch wide tandem axle trailer. Internal rub-rail members 40 are preferably spaced to receive and guide a standard ninety six inch wide tandem axle trailer. The end portions of external rub-rail members 38 are preferably curved outwardly and the end portions of internal rub-rail members 40 are preferably curved inwardly, so as to facilitate receipt of the trailer tandems therebetween.

Figure 3:
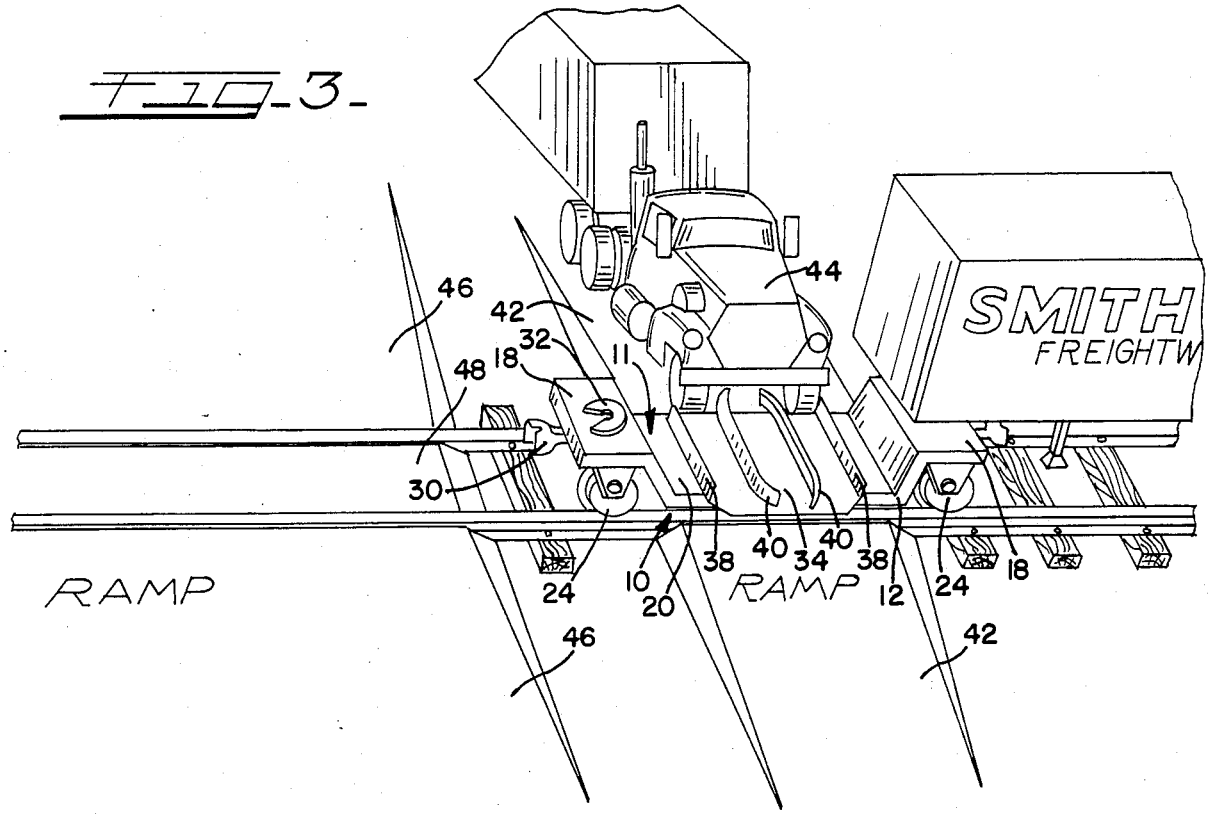
FIGS. 3–9 are perspective views depicting the sequential loading of a semi-trailer between a pair of bogies constructed in accordance with the invention.
Figure 4:
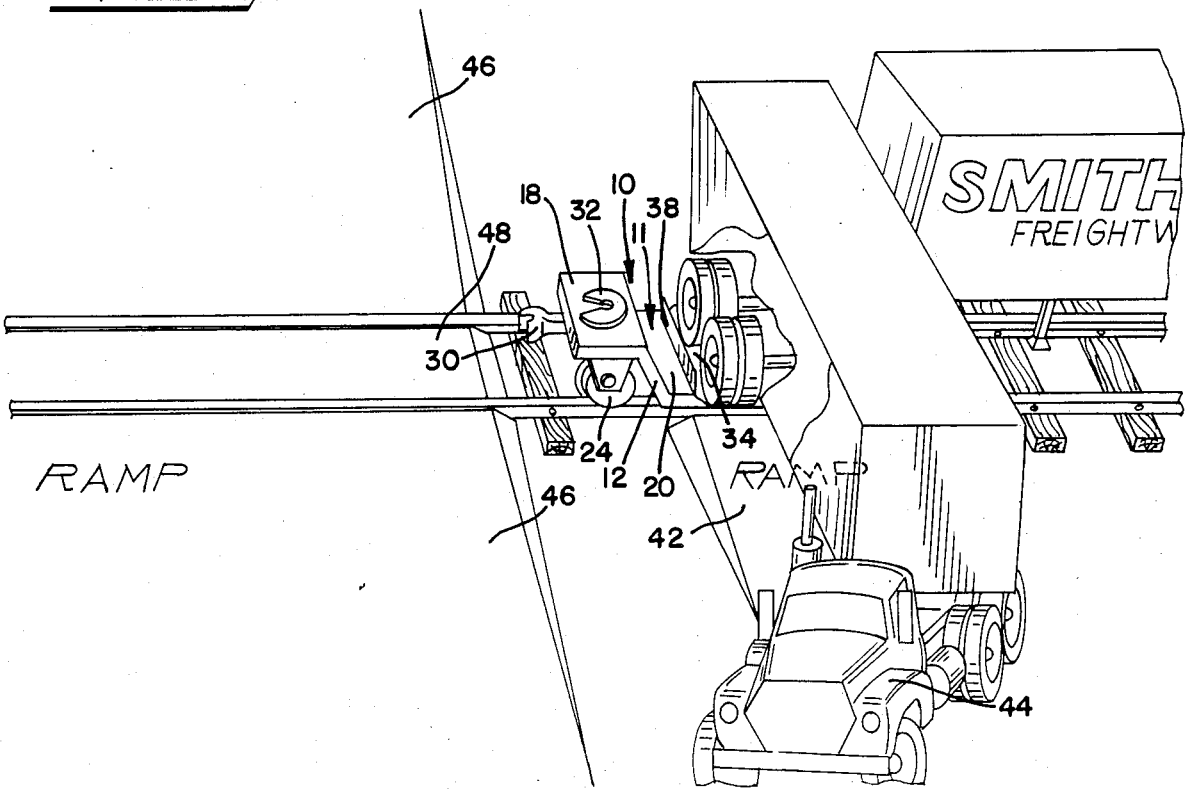
Figure 7:
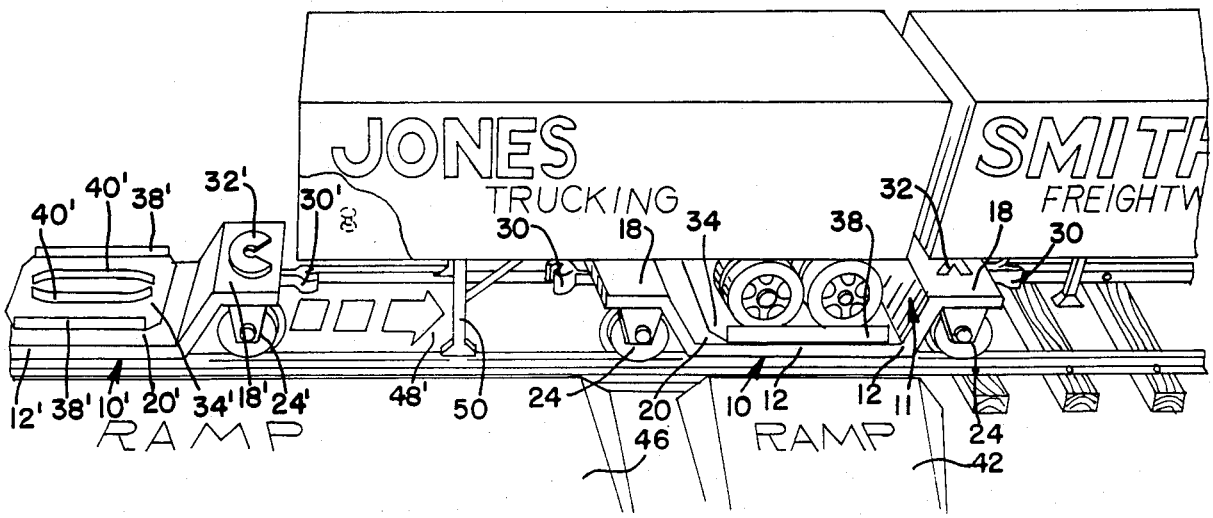
Figure 8:
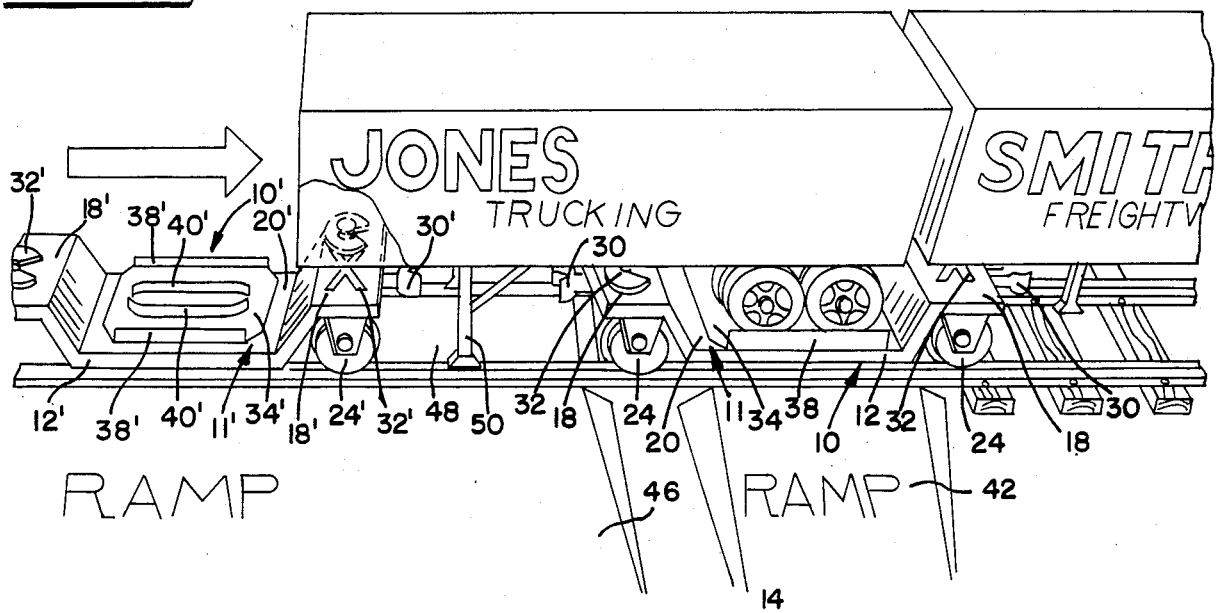
Figure 9:
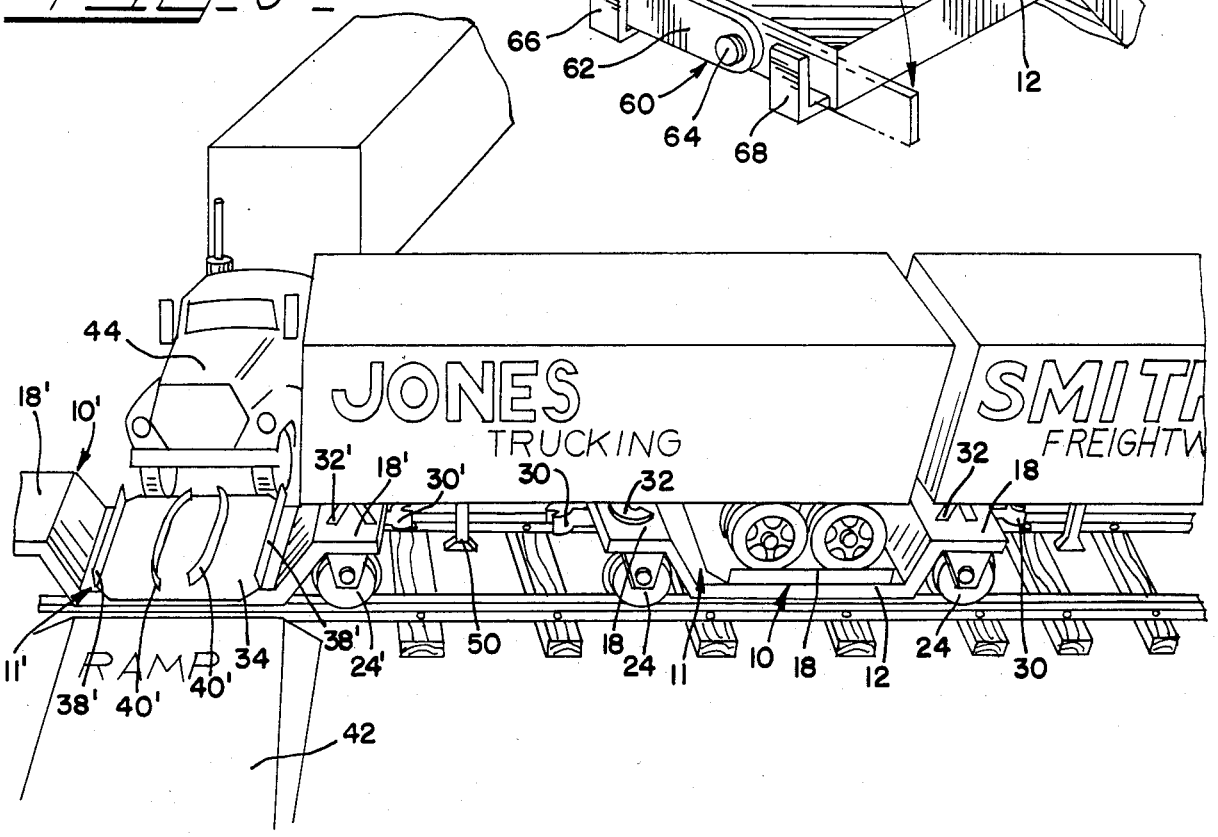

Deck plate member 34 is movable between a first position wherein members 38 and 40 are substantially parallel to the longitudinal axis of the frame structure 11, as shown in FIGS. 1, 2, 6, 7, and 8, and a second position wherein members 38 and 40 are substantially perpendicular to the longitudinal axis of the frame structure 11, as shown in FIGS. 3, 4 and 9. The mechanism for the selective rotation of deck plate member 34 between its first and second positions does not form an integral part of the present invention and may alternatively take various forms. Exemplary of such mechanisms are those disclosed in U.S. Pat. Nos. 2,782,733, 3,490,389 and 4,425,064.

Referring to FIGS. 3–9, the system of the present invention incorporates a plurality of rail bogies 10 which will now be described in connection with the loading sequence of a semi-trailer (Jones Trucking) onto bogies 10 and 10'.

Referring to FIG. 3, a bogie 10 is positioned adjacent to a loading ramp 42 with its deck plate 34 in its second position in facing relationship to an approaching tractor 44. The SMITH trailer is already loaded and setting on the fifth wheel assembly (not shown), which is in its raised position to receive the king pin of the SMITH trailer. Fifth wheel assembly 32 is in its lowered position. The tractor 44 approaches and is driven up, onto, and over the deck plate 34. As the tractor and then the JONES trailer passes over the deck plate 34, the internal and external rub-rail members 38 and 40 serve to guide same therethrough.

Figure 5:
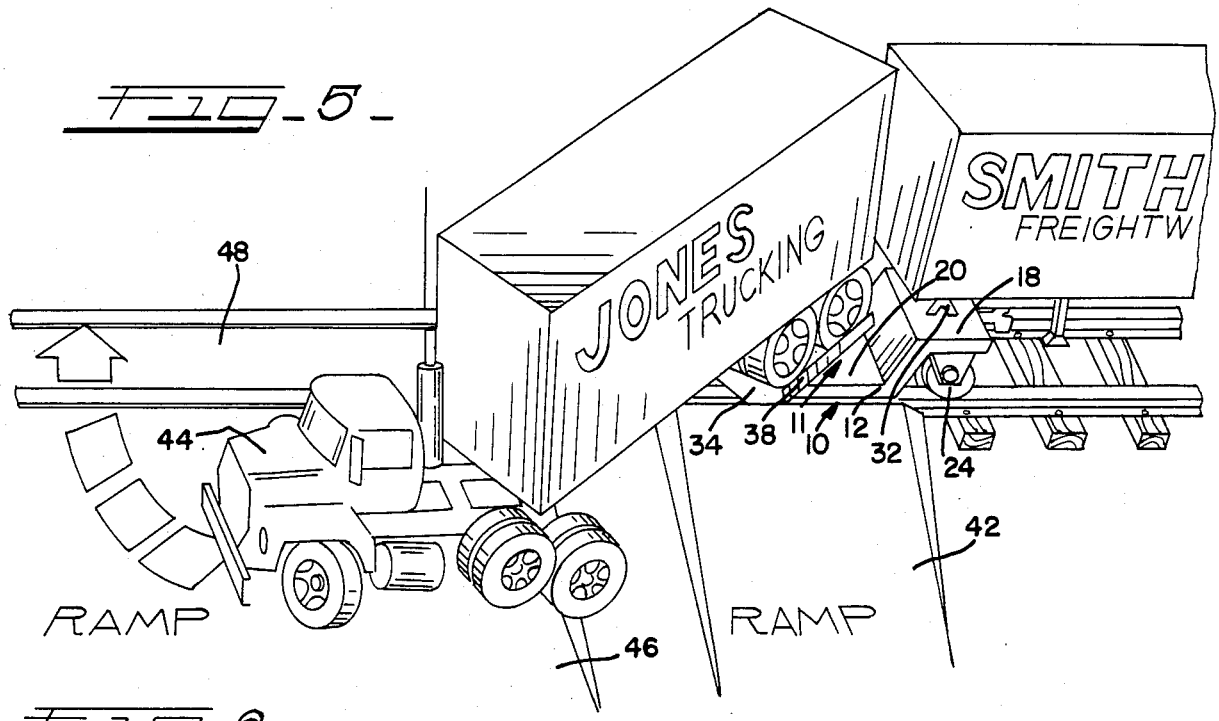

The tractor is stopped when the rear tandem axles of the JONES trailer are positioned squarely on deck plate 34 between the members 38 and 40, as seen in FIG. 4. At this point, or before, the fifth wheel 32 to left of the JONES trailer is lowered to a position a short distance above deck surface 18. The driver, after setting the trailer brakes and properly chocking the trailer wheels, then proceeds to start what is known as a "jacknife" maneuver. This is accomplished by driving the tractor 44 back toward the track upon which the bogie sets, thus rotating the JONES trailer ninety degrees, as shown in FIG. 5. It is of interest to note that there are two loading ramps 42 on either side of the bogie 10. Thus, the bogie 10 can be loaded from either side by driving through as discussed hereinabove, or, alternatively, by backing the trailer up onto the bogie 10.

Figure 6:
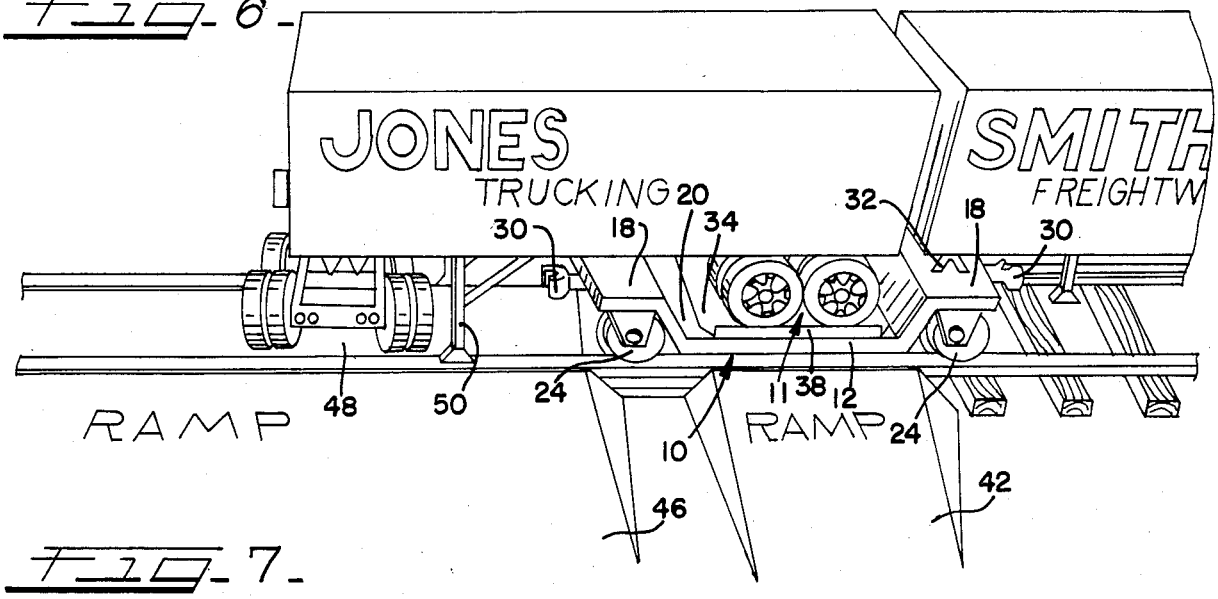

Referring to FIG. 6, after completion of the jacknifing operation, the JONES trailer is positioned with its longitudinal axis substantially parallel to the longitudinal axis of bogie 10. In so positioning the JONES trailer, the tractor 44 not only turns back to the tracks but actually climbs up onto them with the assistance of another ramp 46. The area between the rails at this point is also preferably elevated by a suitable platform 48. Once the driver is satisfied that the trailer is lined up properly, he cranks the landing legs 50 of the JONES trailer down as far as they will go (typically about twenty inches) and lowers the hydraulic fifth wheel on the tractor (not shown) until the sand shoes or bottom parts of the landing legs 50 rest on the rails or platform 48. The driver then uncouples the tractor 44 from the JONES trailer and goes to get the next trailer to be loaded.

If the tractor is not equipped with a hydraulic fifth wheel, the driver would lower the landing legs 50 as far as possible and uncouple the trailer, and then come back and continue to lower the landing legs 50 until they reach their maximum point of extension. Alternatively, the platform 48 may be provided with hydraulic means permitting the raising and lowering thereof to position the trailer king pin to its proper height for match-up to the fifth wheel assembly 32' of bogie 10'.

Referring to FIG. 7, the bogie 10' is moved into position for coupling with the JONES trailer which is already at a match-up height. The deck plate 34' of bogie 10' is shown in its first position, which is the normal position thereof when a bogie is moved to the loading area.

Referring to FIG. 8, the king pin of the JONES trailer is coupled to the adjacent fifth wheel assembly 32' of bogie 10'. The fifth wheel assemby 32' is moved into its raised position immediately prior to such hook-up. Once the hook-up is completed, the air brake hoses are connected and the landing legs 50 are raised to at least six inches above the rail. At this point, if the gap between the JONES trailer and the SMITH trailer is excessive, the driver may longitudinally adjust the position of the fifth wheel assembly 32 engaging the SMITH trailer. The brakes on the bogies 10 and 10' are released and the brakes on the bogie on which the SMITH trailer tandems are setting are locked and the fifth wheel assembly 32 is unlocked. By pushing the bogies 10 and 10' to the right, the fifth wheel assembly 32 in the SMITH trailer is adjusted and the gap between the JONES trailer and the SMITH trailer is accordingly adjusted. Once this is accomplished, the fifth wheel 32 is locked in place. Now, with the two trailers loaded, all of the bogie brakes are released and the train is pushed to the right in the direction of the arrow in FIG. 8. This can be accomplished by a truck tractor locomotive, a trackmobile, or a diesel locomotive, connected to one of the couplers at the end of each bogie. The next bogie to be loaded is properly lined up at ramp 42, the brakes are set on all of the bogies, the deck plate is moved into its second position, and the next bogie is ready for loading, as shown in FIG. 9.

The unloading of trailers from the bogies is accomplished by reversing the hereinabove described loading procedure.

Figure 10:
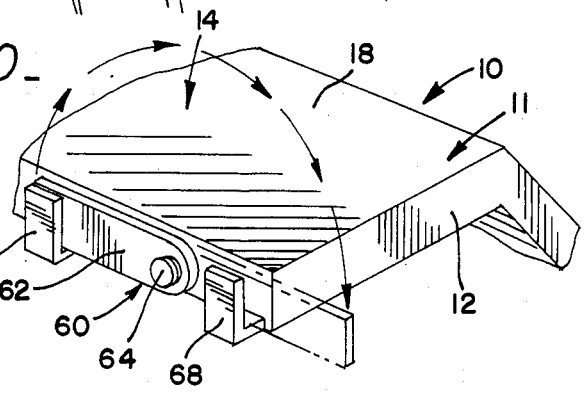
FIG. 10 is a perspective view of a portion of the rail bogie showing an alternative embodiment incorporating pusher arm assemblies to facilitate movement of the bogie.

Referring to FIG. 10, in accordance with an alternative embodiment of the invention, one or more pusher arm assemblies 60 may be provided adjacent one or both of the ends of the bogie 10 to facilitate the movement of the bogie by a conventional tractor positioned alongside of the rails. Pusher arm assembly 60 preferably includes a pusher arm plate 62 which is pivotally secured adjacent one end thereof to a rear portion of end portion 14 through a suitable pivot pin 64. Pusher arm plate 62 is movable between a first position which extends inwardly of the side of bogie 10, as shown in solid lines in FIG. 10, and a second position which extends outwardly of the side of bogie 10, as shown in phantom lines in FIG. 10. Pusher arm plate 62 is secured in its first and second positions respectively by angle brackets 66 and 68 secured to the rear of end portion 14. In order to maximize the flexibility of bogie 10, a pair of pusher arm assemblies 60 may be provided at each end of the bogie, one extending outwardly from each side thereof.

In operation of the pusher arm assembly 60, at such time as it is necessary to move bogie 10, the pusher arm plate 62 is moved from its first position into its second or extended position. With plate 62 so positioned, a conventional tractor may be moved alongside of the bogie so as to cause the bumper thereof to contact the plate 62 and thereby permit the tractor to push the bogie along the rails. By so doing, the heretofore necessity of positioning a trackmobile or diesel locomotive on the rails to effect such movement of the bogies is eliminated. Upon positioning of the bogie, the plate 62 is returned to its first or stored position.

While a preferred embodiment of the invention has been illustrated and described herein, variations will become apparent to one of ordinary skill in the art. Accordingly, the invention is not to be limited to the specific embodiment illustrated and described herein, and the true scope and spirit of the invention are to be determined by reference to the appended claims.

What is claimed is:

1. In a system for transporting by rail a highway semi-trailer supported between first and second unconnected rail bogies, each of said rail bogies comprising: a frame structure supported on wheeled axles positioned adjacent the respective ends thereof, said frame structure defining end deck surfaces positioned above said wheeled axles and a central drop-deck surface disposed between said wheeled axles; fifth wheel assemblies supported above each of said end deck surfaces, said fifth wheel assemblies being selectively vertically adjustable relative to said end deck surfaces; a deck plate member pivotably secured to said drop-deck surface for rotation with respect thereto about a substantially vertical axis, said drop-deck plate member having a pair of transversely spaced longitudinally extending external rub-rail members and a pair of longitudinally extending internal rub-rail members extending upwardly therefrom for receipt of semi-trailer tandem wheels therebetween, said drop-deck plate member being selectively movable between a first position wherein said external and internal rub-rail members are substantially parallel to the longitudinal axis of said frame structure and a second position wherein said external and internal rub-rail members are substantially perpendicular to the longitudinal axis of said frame structure, so as to permit receipt and support of the tandem wheels of a semi-trailer on said drop-deck plate member of said first rail bogie when said drop-deck plate is in its second position and, upon movement of said drop-deck plate into its first position, to position the longitudinal axis of the semi-trailer parallel to the longitudinal axis of said first rail bogie, to permit the receipt and support of the king pin of the highway semi-trailer on a fifth wheel assembly supported on an adjacent end deck surface of said second rail bogie positioned adjacent thereto.

2. The invention as defined in claim 1 wherein said fifth wheel assemblies are selectively longitudinally movable on said end deck surfaces.

3. The invention as defined in claim 1 wherein the end portions of said external rub-rail members are curved outwardly.

4. The invention as defined in claim 3 wherein the end portions of said internal rub-rail members are curved inwardly.

5. The invention as defined in claim 1 wherein coupling means are provided at the respective ends of said frame structure.

6. The invention as defined in claim 1 including a pusher arm means which extends transversely outwardly from a side of said bogie adjacent at least one end thereof.

7. The invention as defined in claim 6 wherein said pusher arm means includes a pusher arm plate pivotally secured adjacent at least one end of said bogie and selectively movable between a first position which extends inwardly of a side of said bogie and a second position which extends outwardly of a side of said bogie.

8. The invention as defined in claim 7 wherein angle brackets are provided to retain said pusher arm plate in its first and second positions.

* * * * *